US008299342B2

(12) United States Patent
Wang et al.

(10) Patent No.: US 8,299,342 B2
(45) Date of Patent: Oct. 30, 2012

(54) BOARD CAPABLE OF GENERATING A HARMONIC SOUND

(75) Inventors: Bor-Tsuen Wang, Neipu Hsiang (TW); Hsiao-Ming Chien, Neipu Hsiang (TW)

(73) Assignee: National Pingtung University of Science and Technology, Pingtung County (TW)

( * ) Notice: Subject to any disclaimer, the term of this patent is extended or adjusted under 35 U.S.C. 154(b) by 35 days.

(21) Appl. No.: 13/086,451

(22) Filed: Apr. 14, 2011

(65) Prior Publication Data

US 2012/0061175 A1 Mar. 15, 2012

(30) Foreign Application Priority Data

Sep. 10, 2010 (TW) ..... 99130765 A

(51) Int. Cl.
*G10D 13/08* (2006.01)

(52) U.S. Cl. ..... 84/404

(58) Field of Classification Search ..... 84/402–410
See application file for complete search history.

(56) References Cited

U.S. PATENT DOCUMENTS

| | | | | |
|---|---|---|---|---|
| 3,780,612 | A * | 12/1973 | Robinson | 84/173 |
| 4,649,791 | A * | 3/1987 | Sawada et al. | 84/402 |
| 2007/0079693 | A1 | 4/2007 | Valli et al. | |
| 2007/0163418 | A1 | 7/2007 | Allred, III | |

* cited by examiner

*Primary Examiner* — Kimberly Lockett

(74) *Attorney, Agent, or Firm* — Alan Kamrath; Kamrath IP Lawfirm, PA

(57) ABSTRACT

A board includes a board body having a striking face and first and second symmetric axes defined in the striking face and perpendicular to each other and intersect with each other at a center of the striking face. The body includes first and second edges symmetric to each other relative to the first symmetric axis. The body further includes first and second wavy edges symmetric to each other relative to the second symmetric axis. The striking face is surrounded by the first and second edges and the first and second wavy edges. When an area around the center of the striking face is stricken, a plurality of natural frequencies is generated. The overtones of the natural frequencies are approximately integer multiple of the fundamental frequency, providing a harmonic sound and enhancing the sweetness of the sound.

8 Claims, 2 Drawing Sheets

BOARD CAPABLE OF GENERATING A HARMONIC SOUND

BACKGROUND OF THE INVENTION

1. Field of the Invention

The present invention relates to a board that generates a harmonic sound when stricken and, more particularly, to a board that generates a harmonic sound when stricken.

2. Description of the Related Art

Percussion instruments can generate sounds through vibration resulting from striking or beating. The vibration patterns are different according to the shapes, sizes, and material of structure, so that the structure can generate differing natural frequencies to produce different sounds of different scales (such as Do, Re, Me . . . ).

A conventional percussion instrument in the market, such as a metalophone or xylophone, generally includes a plurality of bars or boards of differing sizes mounted on a frame at regular intervals. Sounds (Do, Re, Me . . . ) can be generated when the boards are stricken.

FIG. 1 shows a conventional board 9 of a percussion instrument. The board 9 is rectangular in cross section and includes a striking face 91 for generating a plurality of natural frequencies. A smallest one of these natural frequencies is called the fundamental frequency. The remaining natural frequencies are called overtones. However, the overtones are not integer multiples of the fundamental frequency, such that the sound generated by the board 9 is in dissonance. As a result, the sound generated by the board 9 is monotonous and not sweet.

Thus, a need exists for a novel board that generates a harmonic sound when stricken.

SUMMARY OF THE INVENTION

An objective of the present invention is to provide a board having overtones that are integer multiples of the fundamental frequency, so that the board generates harmonic sound when stricken.

The present invention fulfills the above objective by providing, a board capable of generating a harmonic sound including a board body having a striking face, a first symmetric axis, and a second symmetric axis. The first and second symmetric axes are defined in the striking face and perpendicular to each other and intersect with each other at a center of the striking face. The body includes first and second edges located on two opposite sides of the striking face. The first and second edges are symmetric to each other relative to the first symmetric axis. The body further includes first and second wavy edges located on the other two opposite sides of the striking face. The first and second wavy edges are symmetric to each other relative to the second symmetric axis. The striking face is surrounded by the first and second edges and the first and second wavy edges.

By such arrangement, when an area around the center of the striking face is stricken, a plurality of natural frequencies is generated. The overtones of the natural frequencies are approximately integer multiple of the fundamental frequency, providing a harmonic sound and enhancing the sweetness of the sound.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

The term "harmonic sound" used herein refers to that the overtones are integer multiples of the fundamental frequency.

Figure 1:
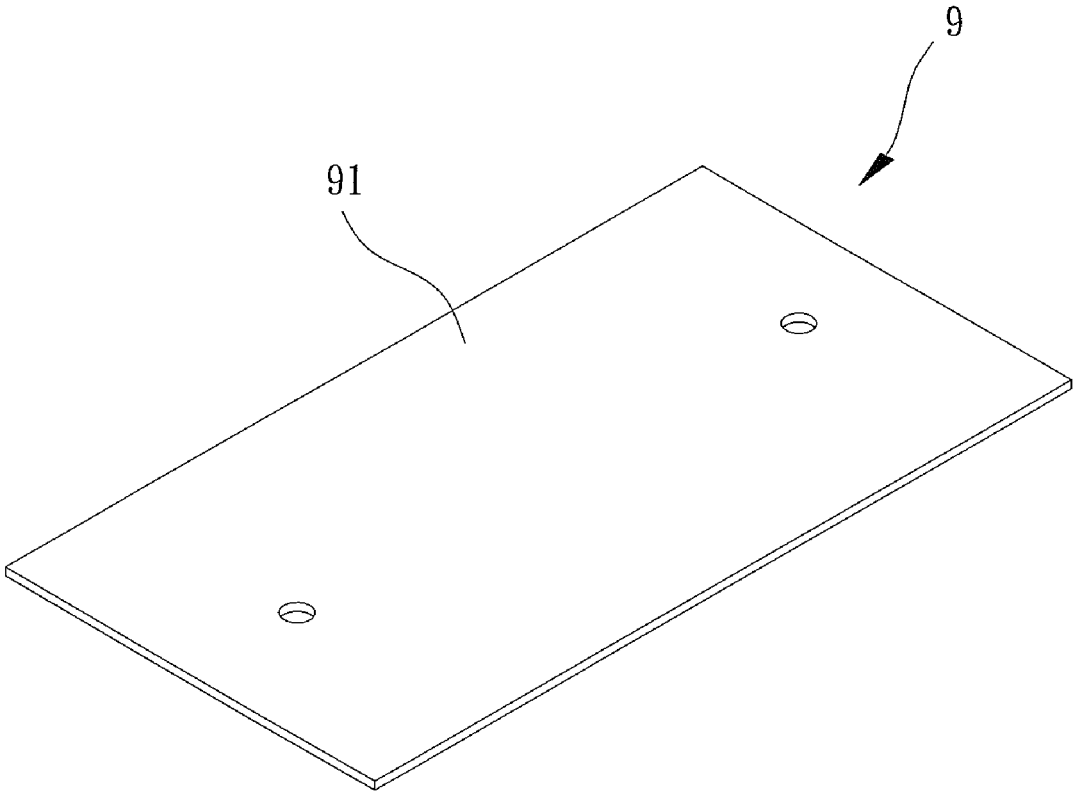
FIG. 1 PRIOR ART
FIG. 1 shows a perspective view of a board of a conventional percussion instrument.
Figure 2:
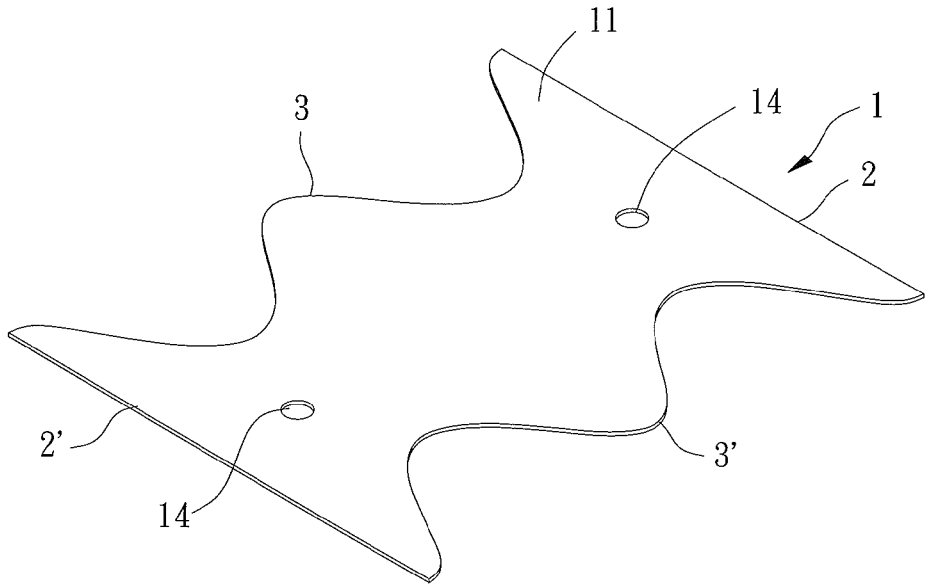
FIG. 2 shows a perspective view of a board according to the present invention.
Figure 3:
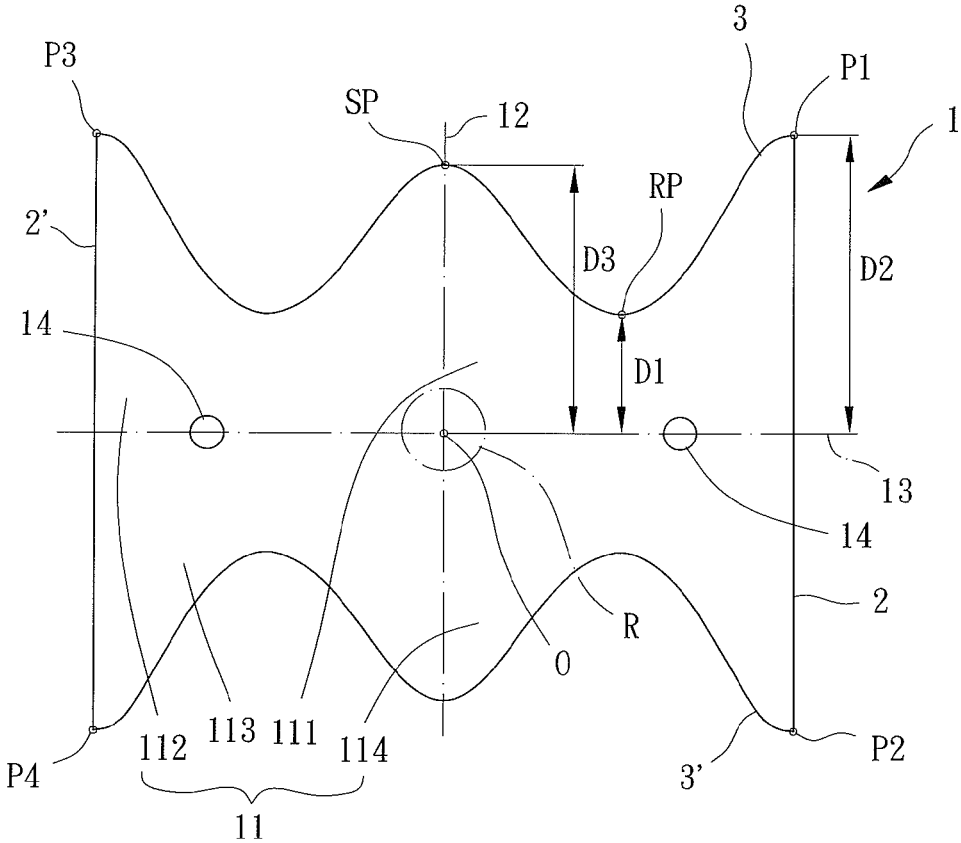
FIG. 3 shows a top view of the board of FIG. 2.

With reference to FIGS. 2 and 3, a board according to the present invention can be utilized in a percussion instrument, such as a metalophone or xylophone. In this embodiment, the board is utilized in a metalophone. The board includes a board body 1 having first and second edges 2 and 2' and first and second wavy edges 3 and 3'. A face of the board body 1 is surrounded by the first and second edges 2 and 2' and the first and second wavy edges 3 and 3'.

The board body 1 is made of metal (such as steel or iron) in this embodiment and has a uniform thickness. However, the board body 1 can be made of glass or other material. The board body 1 includes a top face, a bottom face opposite to the top face, and a plurality of side faces extending between the top and bottom faces. In this embodiment, the top face of the board body 1 is used as a striking face 11 that can be stricken by a mallet to cause vibration of the board body 1 for generating a sound. The board body 1 includes first and second symmetric axes 12 and 13 defined in the striking face 11. The first and second symmetric axes 12 and 13 are perpendicular to each other and intersect with each other at a center O of the striking face 11. A striking area R is formed around the center O. With reference to FIG. 3, the striking area R is a circle in this embodiment. Thus, when the striking area R is stricken by a mallet, the board body 1 generates a fundamental frequency and a plurality of overtones each of which is an integer multiple of the fundamental frequency of the board body 1, obtaining a harmonic sound.

Furthermore, the board body 1 includes two assembly holes 14 extending from the top face through the bottom face. Preferably, the assembly holes 14 are located on the second symmetric axis 13 and symmetric to each other relative to the first symmetric axis 12. The board body 1 can be mounted to a frame of a metalophone by the assembly holes 14 and can be stricken by a player. The first and second symmetric axes 12 and 13 define four quadrants in a two dimensional, planar coordinate. Thus, the striking face 11 is divided into first, second, third, and fourth sections 111, 112, 113, and 114 (starting counterclockwise from the first quadrant) having an identical shape and an identical area.

Each of the first and second edges 2 and 2' are rectilinear and located on two opposite sides of the striking face 11 and symmetric to each other relative to the first symmetric axis 12. The side faces extending between the first and second edges 2 and 2' are plane. In this embodiment, the first and second edges 2 and 2' are parallel to the first symmetric axis 12. The first edge 2 has two end points P1 and P2. The second edge 2' has two end points P3 and P4.

Each of the first and second wavy edges 3 and 3' are smooth, wavy curves. The first and second wavy edges 3 and 3' are located on the other two opposite sides of the striking face 11 and are symmetric to each other relative to the second symmetric axis 13. Thus, the side faces connected to the first and second wavy edges 3 and 3' are curved. The first end point P1 and the third end point P3 form two ends of the first wavy edge 3. The second end point P2 and the fourth end point P4 form two ends of the second wavy edge 3'.

Detailed description of the first and second wavy edges 3 and 3' will now be set forth using the first wavy edge 3 as an example. The second wavy edge 3' is symmetric to the first wavy edge 3 and, thus, requires no redundant descriptions.

With reference to FIG. 3, the first symmetric axis 12 intersects the first wavy edge 3 at a reference point SP. The reference point SP, the first end point P1, and the third end point P3 are not located on the same line. The reference point SP equally separates the first wavy edge 3 into first and second smooth curve sections symmetric to each other relative to the first symmetric axis 12. Description of the first curve section between the reference point SP and the first end point P1 will now be set forth. The second curve section between the reference point SP and the third end point P3 is symmetric to the first curve section between the reference point SP and the first end point P1. Specifically, the first curve section includes a reference point RP other than the reference point SP and the first end point P1. The reference point RP has a first spacing D1 to the second symmetric axis 13. The first end point P1 has a second spacing D2 to the second symmetric axis 13. The reference point SP has a third spacing D3 to the second symmetric axis 13.

In this embodiment, the first spacing D1 is the shortest distance between the first curve section and the second symmetric axis 13. The second spacing D2 is the longest distance between the first curve section and the second symmetric axis 13. The third spacing D3 is larger than the first spacing D1 but smaller than the second spacing D2. Namely, the each of the first and second wavy edges 3 and 3' in this embodiment is in the form of a smooth curve having a peak and two troughs.

In use, the board body 1 is mounted on the frame of the metalophone, and the player can strike the striking area R to generate a harmonic sound. Furthermore, the board can be used as a wind-bell. Specifically, the board body 1 and a rod can be hung from a balcony with an end of the rod aligned with the striking area R of the striking face 11. When the rod sways due to wind, the end of the rod strikes the striking area R of the striking face 11 to generate a harmonic sound.

Tests were conducted to examine whether the sound generated by the board are harmonic. An impact hammer was utilized to strike the striking area R. A microphone and an accelerometer were utilized as sensors for measurement. Frequency response functions were obtained by using a spectrometer. The natural frequencies were extracted based on the frequency response functions by using ME'scope VES (curve-fitting software). Then, the natural frequencies were compared with the harmonic sound of C6 scale. The material parameters of the board body 1 are shown in Table 1, and the results after comparison are shown in Table 2.

TABLE 1

| | |
|---|---|
| density (kg/m$^3$) | 7871.74 |
| Young's modulus (GPa) | 192.95 |
| Poisson's Ratio | 0.27 |
| thickness (mm) | 3 |

TABLE 2

(unit: Hz)

| natural frequency No. | target frequency (TF) | natural frequency of the present invention (F) | error (F − TF) | percent of error $\left(\frac{F-TF}{FT}\times 100\%\right)$ |
|---|---|---|---|---|
| 1 | 1046.50 | 1040.625 | −5.875 | −0.561 |
| 2 | 2093.00 | 2131.25 | 38.250 | 1.828 |
| 3 | 3139.50 | 3103.125 | −36.375 | −1.159 |

Column 2 of Table 2 shows the natural frequencies of C6 scale. Frequency No. 2 is two times frequency No. 1, and frequency No. 3 is three times frequency No. 1. As can be seen from Table 2, the error of the fundamental frequency generated by striking the board according to the present invention relative to the fundamental frequency of the target frequency is in a range of ±6.7 Hz. The percent of error of the overtones of the board according to the present invention relative to the overtones of the target frequency is in a range of ±5%. Thus, the board according to the present invention can indeed generate a harmonic sound.

Furthermore, the natural frequencies resulting from the vibration of the structure fulfills the following equation (1):

$$f \propto \frac{t}{L^2} \tag{1}$$

wherein f is the frequency, L is the size of the structure, t is the thickness of the structure. The natural frequency is in reverse proportion to the square of the size of the structure, which is well known in the field of vibration. When it is intended to manufacture a board capable of generating harmonic sounds of C7 scale or other scales, the size or thickness of the structure can be adjusted according to the ratio between the natural frequencies.

In view of the foregoing, by providing the board according to the present invention including first and second wavy edges 3 and 3' symmetric to the second symmetric axis 13 and including first and second edges 2 and 2' symmetric to the first symmetric axis 12, the board can generate a harmonic sound when it is stricken at the striking area R through generation of a plurality of natural frequencies each of which is an integer multiple of the fundamental frequency, which is convenient in use while increasing the sweetness of the sound.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A board capable of generating a harmonic sound comprising:

a board body including a striking face, a first symmetric axis, and a second symmetric axis, with the first and second symmetric axes defined in the striking face and perpendicular to each other and intersecting with each other at a center of the striking face, with the body including first and second edges located on two opposite sides of the striking face, with the first and second edges symmetric to each other relative to the first symmetric axis, with the body further including first and second wavy edges located on another two opposite sides of the striking face, with the first and second wavy edges symmetric to each other relative to the second symmetric axis, with the striking face surrounded by the first and second edges and the first and second wavy edges.

2. The board capable of generating a harmonic sound as claimed in claim 1, with the first symmetric axis equally dividing each of the first and second wavy edges into two smooth curve sections, with each of the two curve sections having a longest distance to the second symmetric axis, with the longest distance equal to a spacing between the second symmetric axis and an intersection of one of the first and second wavy edges and one of the first and second edges.

3. The board capable of generating a harmonic sound as claimed in claim 2, with each of the two curve sections having a shortest distance to the second symmetric axis, with the shortest distance located between the intersection between one of the first and second wavy edges and one of the first and second edges and an intersection between one of the first and second wavy edges and the first symmetric axis.

4. The board capable of generating a harmonic sound as claimed in claim 1, with each of the first and second edges being rectilinear.

5. The board capable of generating a harmonic sound as claimed in claim 4, with both of the first and second edges parallel to the first symmetric axis.

6. The board capable of generating a harmonic sound as claimed in claim 1, with the board body including a uniform thickness.

7. The board capable of generating a harmonic sound as claimed in claim 1, with the board body further including two assembly holes extending from a top face through a bottom face of the board body, with the two assembly holes symmetric to each other relative to the first symmetric axis.

8. The board capable of generating a harmonic sound as claimed in claim 7, with the two assembly holes located on the second symmetric axis.

* * * * *